US010914127B2

(12) United States Patent
Fay

(10) Patent No.: US 10,914,127 B2
(45) Date of Patent: Feb. 9, 2021

(54) SIDE POCKET MANDREL WITH ENHANCED PRESSURE RATING

(71) Applicant: Peter J. Fay, Houston, TX (US)

(72) Inventor: Peter J. Fay, Houston, TX (US)

( * ) Notice: Subject to any disclaimer, the term of this patent is extended or adjusted under 35 U.S.C. 154(b) by 120 days.

(21) Appl. No.: 16/271,484

(22) Filed: Feb. 8, 2019

(65) Prior Publication Data

US 2020/0256134 A1 Aug. 13, 2020

(51) Int. Cl.
*E21B 17/18* (2006.01)
*E21B 43/12* (2006.01)

(52) U.S. Cl.
CPC ..... *E21B 17/18* (2013.01); *E21B 43/12* (2013.01); *E21B 43/122* (2013.01); *E21B 43/123* (2013.01)

(58) Field of Classification Search
CPC ..... E21B 17/18; E21B 43/12; E21B 43/123; E21B 43/122
See application file for complete search history.

(56) References Cited

U.S. PATENT DOCUMENTS

| | | | |
|---|---|---|---|
| 3,603,393 | A | 9/1971 | Ben et al. |
| 4,416,330 | A | 11/1983 | Merritt et al. |
| 5,797,453 | A | 8/1998 | Hisaw |
| 7,228,909 | B2 | 6/2007 | Schmidt et al. |
| 7,699,108 | B2 | 4/2010 | Bane et al. |
| 7,735,560 | B2 | 6/2010 | Bane |

*Primary Examiner* — Yong-Suk (Philip) Ro
(74) *Attorney, Agent, or Firm* — Steve Rosenblatt

(57) ABSTRACT

The pressure rating of a SPM assembly is enhanced by metal removal in one or more locations. The start of the pocket is reshaped from an elongated shape with a rounded end when viewed in section to a crescent shape from the onset of the pocket to the start of the seal bore in the pocket. Blind bores are disposed generally parallel to the seal bore to further remove bulk of the body portion in view of its asymmetrical design to accommodate the pocket. One or more of these body modifications gets the body reconfigured to be more symmetrical. The added symmetry acts to equalize the stresses all around the periphery of the body with the result being a higher pressure rating for a given outer dimension of the body as compared to the current known designs.

15 Claims, 3 Drawing Sheets

SIDE POCKET MANDREL WITH ENHANCED PRESSURE RATING

FIELD OF THE INVENTION

The field of the invention is side pocket mandrels used in gas lift operations in the hydrocarbon extraction industry and more particularly design modifications to increase the pressure rating of the asymmetrical body of the side pocket mandrel.

BACKGROUND OF THE INVENTION

A known design of a side pocket mandrel is shown in FIGS. 1 through 1*d*. An upper swage 10 is attached on top of body 12 with another swage 14 at an opposite end from swage 10. The assembly compromises five machined components which are but welded together. Upper swage, body, guard, pocket and lower swage. FIG. 1*b* shows the view looking up at section line B-B so that the through passage 16 is shown as well as transition taper 18 in upper swage 10 that is disposed above. As best seen in FIG. 1*c*, passage 16 has an eccentric center 20 with respect to the center 22 of the housing 12. Side pocket 24 begins just above section line C-C, as shown in FIG. 1*c*. Side pocket 24 has a latch profile 26 so that a valve that is not shown with external seals can be positioned with the external seals in a seal bore 28. When in such a position the valve that is not shown is sealed in the side pocket 24 and has its inlet aligned with port or ports 30 of housing or body 12. The ports 30 are spaced such that alignment with the pocket is nominally guaranteed and the pocket 24 has an undercut which allows fluid to flow between the valve (not shown) and pocket 24 to account for any minor misalignment. Gas is delivered from the surrounding annulus 32 through inlet port 30 to the valve that is not shown and out the bottom of the valve that is not shown and disposed in seal bore 28 into passage 16 to lift hydrocarbons to the surface. The pocket 24 starts as an oblong shape shown in FIG. 1*c* and transitions to a round shape for the seal bore 28.

FIGS. 1*c* and 1*d* reveal a relatively thin wall 34 on one side that is opposed by a fairly thick wall 36 due to the asymmetrical nature of the components to accommodate the side pocket 24 location to the side of the through passage 16. The result of this long standing design is that stresses build in wall 34 with the result that the pressure rating of the assembly has to be reduced for safe operation. The present invention addresses this reduction in pressure rating from stress concentrating in wall 34 by removing material from opposing wall 36 in a variety of locations with the result of a more equal distribution of stresses to enable a higher pressure rating. The present invention provides for removal of exterior wall material, a reconfiguration of the shape of the side pocket 24' at its entrance or/and the addition of blind bores flanking the seal bore 28'. Those skilled in the art will more readily appreciate these and other aspects of the invention by a review of the description of the preferred embodiment and the associated Figures while recognizing that the full scope of the invention is to be determined by the literal and equivalent scope of the appended claims.

The following references are relevant to the state of the art of side pocket mandrel design: U.S. Pat. No. 4,416,330 a basic design for today's high pressure mandrels; U.S. Pat. No. 3,603,393 an older side pocket mandrel design still in use today but with a lesser pressure rating; U.S. Pat. No. 5,797,453 showing conveyance of a valve into a side pocket mandrel (SPM) by means of an improved kick over tool; U.S. Pat. No. 7,228,909 shows a fairly standard side pocket mandrel design with check valve addition as an improvement.

U.S. Pat. No. 7,699,108 is a rod piston operated subsurface safety valve where the concern with distortion of a piston bore under pressure is addressed with the addition of adjacent blind bores or sleeves added in the rod piston cylinder.

SUMMARY OF THE INVENTION

The pressure rating of a SPM assembly is enhanced by metal removal in one or more locations. External grooves may be used in the thicker portion of the SPM body for the conveyance of hydraulic or electric control lines around the SPM assembly. The start of the pocket is reshaped from an elongated shape with a rounded end when viewed in section to a crescent shape from the onset of the pocket to the start of the seal bore in the pocket. Blind bores are disposed generally parallel to the seal bore to further remove bulk of the body portion in view of its asymmetrical design to accommodate the pocket. One or more of these body modifications gets the body reconfigured to be more symmetrical. The added symmetry acts to equalize the stresses all around the periphery of the body with the result being a higher pressure rating for a given outer dimension of the body as compared to the current known designs.

DETAILED DESCRIPTION OF THE PREFERRED EMBODIMENT

Figure 1:
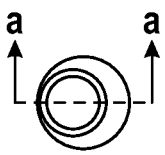
FIG. 1 is a top view of a prior art SPM.
Figure 1A:
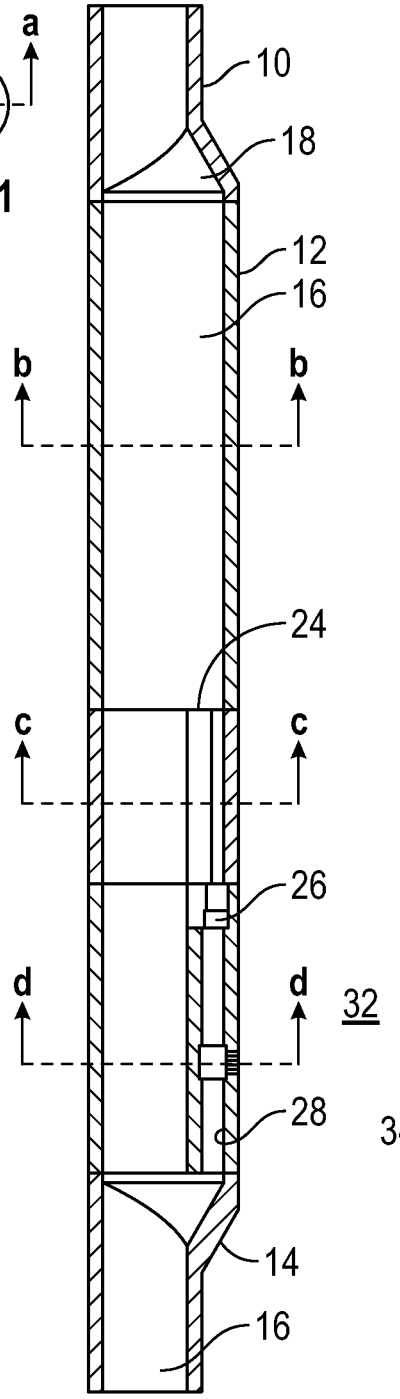
FIG. 1*a* is a section view through line a-a of FIG. 1.
Figure 1B:
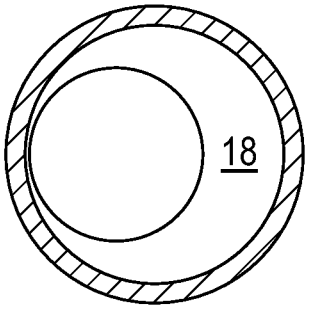
FIG. 1*b* is a section view along line b-b of FIG. 1*a;*
Figure 1C:
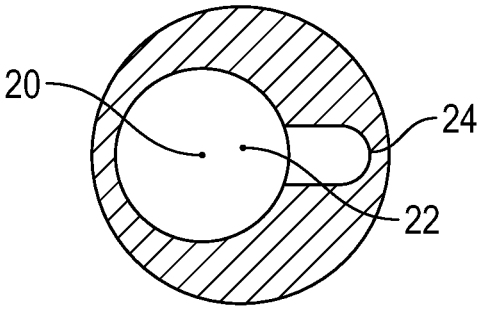
FIG. 1*c* is a section view along line c-c of FIG. 1*a;*
Figure 1D:
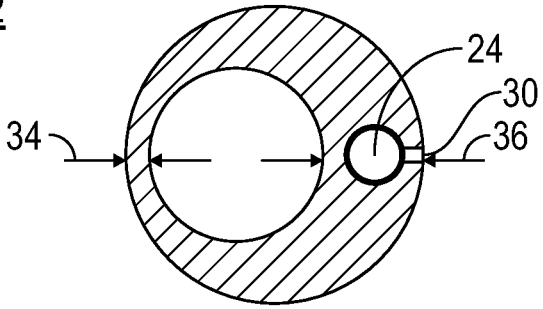
FIG. 1*d* is a section view along line d-d of FIG. 1*a;*
Figure 2:
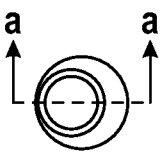
FIG. 2 is a top view of the SPM of the present invention.
Figure 2A:
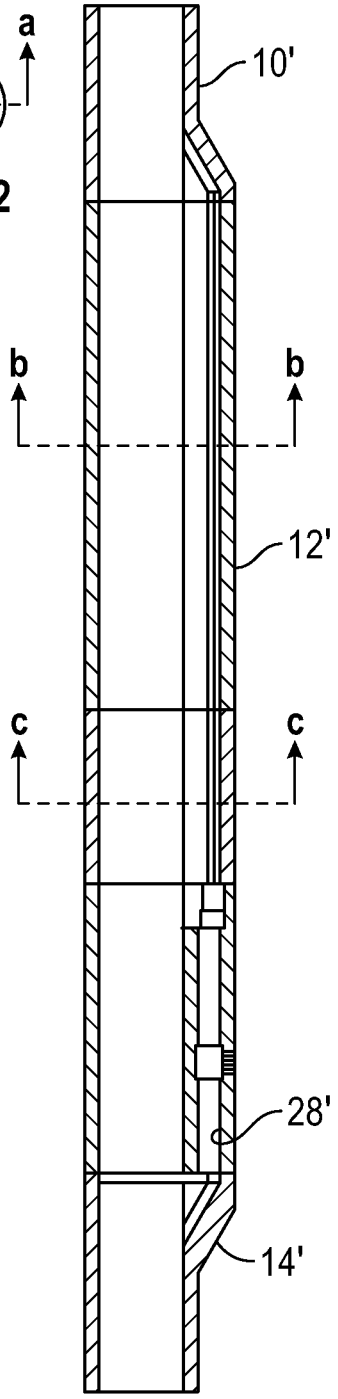
FIG. 2*a* is a section view along line a-a of FIG. 2.
Figure 2B:
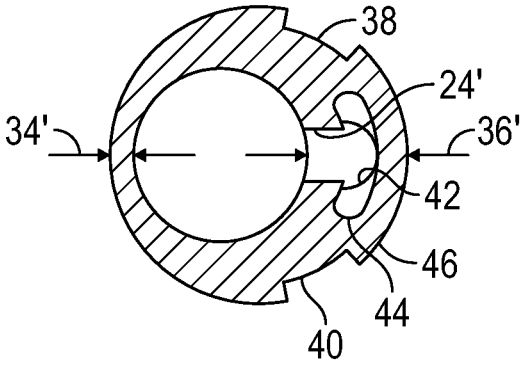
FIG. 2*b* is a section view along line b-b of FIG. 2*a;*
Figure 2C:
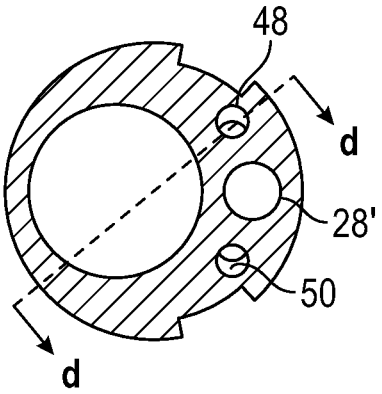
FIG. 2*c* is a section view along line c-c of FOG. 2*a;*

Referring to FIGS. 2 and 2*b*, exterior longitudinal grooves 38 and 40 can straddle the pocket 24' and extend axially generally parallel to the pocket 24' preferably extending the substantial distance between upper swage 10' and the seal bore 28'. These grooves can be put into the thicker wall 36' in an effort to reduce its bulk as one approach toward equalizing stresses in walls 34' and 36' to raise the pressure rating of the assembly that includes body 12' and eccentric end connections 10' and 14'.

Another approach can be instead of using a semicircular outer end to the entrance of the pocket 24' a crescent shaped expansion 44 of the semicircular shape 42 can be machined in the body 12' before the end connection 10' is secured. One of the curved surfaces of the crescent shape 44 is preferably tangent to the semicircular end shape of the axially oriented slot that defines the entrance of pocket 24' above the seal bore 28'. The crescent shaped expansion can be adjacent or intersecting the semicircular shape and preferably has a similar radius on opposed sides that define the crescent shape that follows the outermost surface of the thicker wall portion 36'. The crescent shaped bore 44 preferably extends the length of the axially oriented slot that defines the entrance of pocket 24' above the seal bore 28' Preferably the semicircular shaped arc follows the outer surface 46 of the body 12' in the location of wall 36'. The crescent shape can extend out one side or both sides of semicircular shape 42 or can be disposed adjacent to it without intersecting or overlapping in any way. Here again, wall material is removed in an effort to redistribute toward equalization, the stresses on wall 36' with wall 34' which has the effect of raising the pressure rating of the assembly. Preferably, the width of the crescent shaped segment is equal or greater than the seal bore 28' diameter.

Figure 2D:
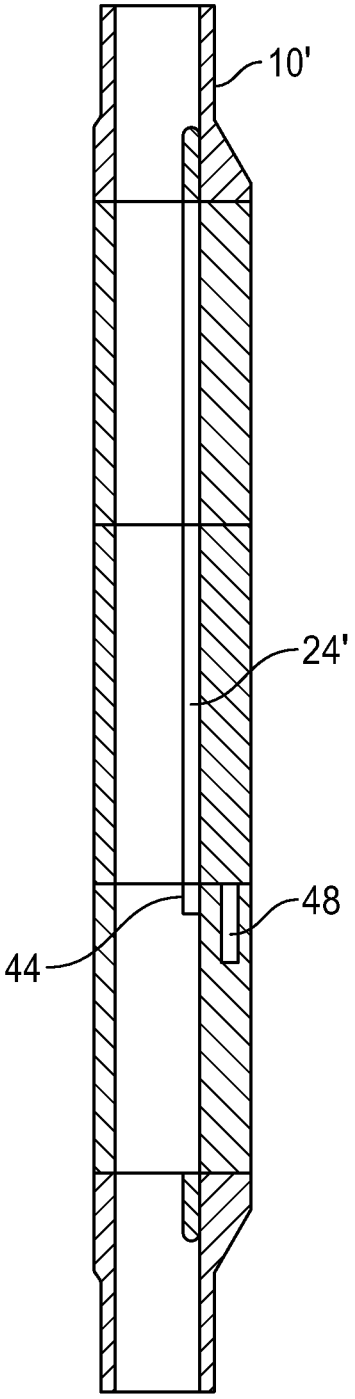
FIG. 2*d* is a section view rotated from the section view of FIG. 2*a* showing a blind bore adjacent the seal bore of the pocket.
Figure 2E:
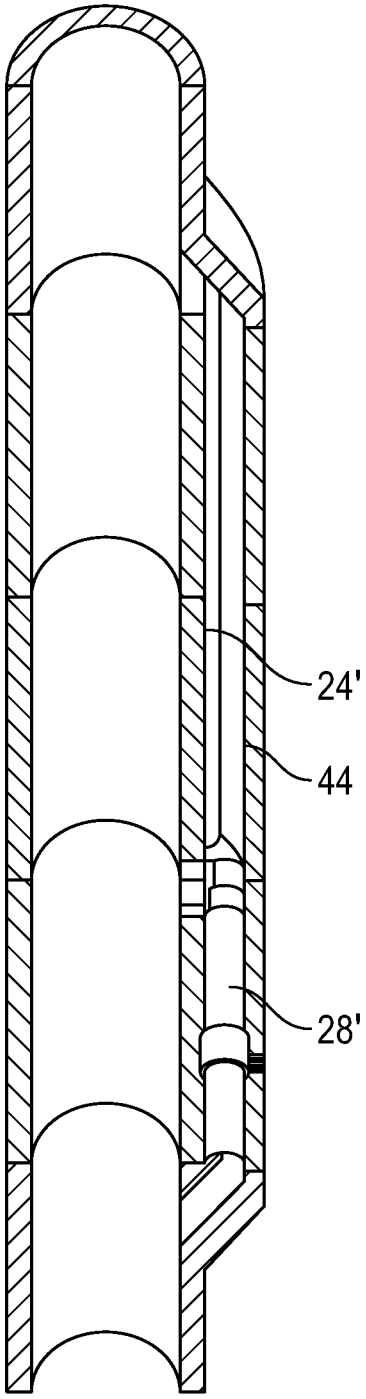
FIG. 2*e* is a perspective view of the section view in FIG. 2*a*.

Another approach is to provide blind bores 48 and 50 preferably on opposed sides of the seal bore 28' but alternatively only on one side of the seal bore 28'. FIG. 2*d* shows one of the blind bores 48 in a rotated section extending in an axially overlapping relation with the crescent shaped extension 44 of the pocket 24'. FIG. 2*e* shows the pocket 24' that has a crescent shape 44 leading into the circular seal bore 28'.

While two different approaches to reducing stress resistance of eccentric wall 36' are illustrated one or more than one approach can be applied with the results predicted with finite element analysis known to those skilled in the art of stress analysis. While the direction of bores 48 and 50 is shown as generally axial their orientation can be perpendicular or skewed to the orientation shown. While two such bores are shown, one or more than two such bores can be used and disposed on one side of seal bore 28' or on opposed sides. The enlargement of the pocket 24' can also have shapes other than a crescent but the crescent shape removes more material while best maintaining the pressure integrity of the body 12'. While the external grooves 38 and 40 are shown with square corners, they can also have other shapes and orientations apart from long axial slots. As viewed in FIG. 2*b* the grooves 38 and 40 can be U or V shaped or can be an array of radial bores into body 12'. One advantage of the grooves in whatever shape being on the outside of the body 12' is that an existing SPM can be modified and rerated for higher pressure with only exterior modifications. By incorporating one or more than one of the illustrated wall removal techniques for wall 36' with all other things being equal, the pressure rating can be increased by 40% or more.

Those skilled in the art of SPM will appreciate that this limitation on the pressure rating of SPMs has been a factor for decades without any offered solution by those skilled in the art. Attempts to raise the pressure rating have been in the direction of adding bulk to the SPM body which not only adds weight but reduces the size available for the through passage and the pocket. Instead, the present invention goes in the opposite direction with removal of wall for the eccentric thicker wall so as to move toward equalizing the stress around the periphery of the body as between the thinner and the thicker opposed walls to enhance the pressure rating of the assembly. While the concept is illustrated in context of SPMs, it is equally applicable to other asymmetrical structures where there is a space limitation in the application and a need to boost the pressure rating of the assembly in a cost effective way without a total redesign of the assembly.

The objective of the axial slot or at least one blind bore is to as much as possible make the thicker wall uniformly thinner with the target being the thickness of the thinner opposite wall. Clearly, with blind bores, if circular, will better approach the desired target if multiple such bores are used. However, the slot or bore shape does not need to be circular and other shapes that accomplish the evening out of wall thickness between the thicker and the opposing thinner wall can be used. The most efficient such shape for accomplishing the uniform thinning of the thicker wall is a crescent with a radius smaller than the outer body dimension.

The above description is illustrative of the preferred embodiment and many modifications may be made by those skilled in the art without departing from the invention whose scope is to be determined from the literal and equivalent scope of the claims below.

I claim:

1. A side pocket mandrel assembly comprising a body having a body longitudinal axis and a passage having an offset passage longitudinal axis from said body longitudinal axis and an axially oriented side pocket comprising an elongated slot leading to a seal bore with said seal bore having a seal bore longitudinal axis offset from said body longitudinal axis, said side pocket communicating with an outer surface of said body, said body defining a thinner wall adjacent said passage as compared to a thicker wall adjacent said pocket;

at least one axially oriented bore in said thicker wall communicating on a first end with said side pocket while having a second end extending short of said outer surface of said body to preclude flow therethrough, said axially oriented bore acting to increase the pressure rating of said body.

2. The assembly of claim 1, wherein:

said axially oriented bore intersects said elongated slot.

3. The assembly of claim 2, wherein:

said axially oriented bore extends beyond said elongated slot on at least one side.

4. The assembly of claim 3, wherein:

said axially oriented bore extends beyond said elongated slot on opposed sides.

5. The assembly of claim 4, wherein:

said axially oriented bore comprises a crescent shape.

6. The assembly of claim 5, wherein:

said crescent shape has a curved side tangent to a rounded end of said elongated slot.

7. The assembly of claim 5, further comprising:

said at least one axially oriented bore further comprises a blind bore in said thicker wall adjacent said seal bore, said at least one blind bore acting to increase the pressure rating of said body.

8. The assembly of claim 7, wherein:

said at least one blind bore comprises multiple circular blind bores disposed on at least one side of said seal bore and oriented generally parallel to said seal bore.

9. The assembly of claim 7, wherein:

said body comprising an outermost surface, said outermost surface comprising at least one axial slot in said thicker wall acting to increase the pressure rating of said body.

10. The assembly of claim 9, wherein:

said at least one axial slot extends the substantial length of said elongated slot of said pocket.

11. The assembly of claim 9, wherein:

said at least one axial slot in said outermost surface comprising a plurality of axial slots further comprising a slot shape defined by flat surfaces, at least one rounded surface or a combination of flat surfaces and at least one rounded surface.

12. The assembly of claim 1, wherein:

said axially oriented bore comprises a shape creating a substantially uniform said thicker wall thickness between said axially oriented bore and an outermost surface of the body.

13. A side pocket mandrel assembly comprising a body having a body longitudinal axis and a passage having an offset passage longitudinal axis from said body longitudinal axis and an axially oriented side pocket comprising an elongated slot leading to a seal bore with said seal bore having a seal bore longitudinal axis offset from said body longitudinal axis, said side pocket communicating with an outer surface of said body, said body defining a thinner wall adjacent said passage as compared to a thicker wall adjacent said pocket;

at least one axially oriented blind bore in said thicker wall adjacent said seal bore communicating on a first end with said side pocket while having a second end extending short of said outer surface of said body to preclude flow therethrough, said at least one blind bore acting to increase the pressure rating of said body.

14. The assembly of claim 13, wherein:

said body comprising an outermost surface, said outermost surface comprising at least one axial slot in said thicker wall acting to increase the pressure rating of said body.

15. The assembly of claim 13, wherein:

said at least one axially oriented blind bore comprises a shape creating a substantially uniform said thicker wall thickness between said at least one axially oriented blind bore and an outermost surface of the body.

* * * * *